US006184761B1

(12) United States Patent
Doma et al.

(10) Patent No.: US 6,184,761 B1
(45) Date of Patent: Feb. 6, 2001

(54) CIRCUIT BREAKER ROTARY CONTACT ARRANGEMENT

(75) Inventors: Palani Krishnan Doma, Bristol; Daniel Schlitz, Burlington; David Arnold, Chester, all of CT (US)

(73) Assignee: General Electric Company, Schenectady, NY (US)

( * ) Notice: Under 35 U.S.C. 154(b), the term of this patent shall be extended for 0 days.

(21) Appl. No.: 09/467,457

(22) Filed: Dec. 20, 1999

(51) Int. Cl.[7] ..... H01H 83/00

(52) U.S. Cl. ..... 335/16; 218/22

(58) Field of Search ..... 335/6, 16, 142, 335/195; 218/22, 30–33; 200/244

(56) References Cited

U.S. PATENT DOCUMENTS

| | | |
|---|---|---|
| D. 367,265 | 2/1996 | Yamagata et al. . |
| 2,340,682 | 2/1944 | Powell . |
| 2,719,203 | 9/1955 | Gelzheiser et al. . |
| 2,937,254 | 5/1960 | Ericson . |
| 3,158,717 | 11/1964 | Jencks et al. . |
| 3,162,739 | 12/1964 | Klein et al. . |
| 3,197,582 | 7/1965 | Norden . |
| 3,307,002 | 2/1967 | Cooper . |
| 3,517,356 | 6/1970 | Hanafusa . |
| 3,631,369 | 12/1971 | Menocal . |
| 3,803,455 | 4/1974 | Willard . |
| 3,883,781 | 5/1975 | Cotton . |
| 4,129,762 | 12/1978 | Bruchet . |
| 4,144,513 | 3/1979 | Shafer et al. . |
| 4,158,119 | 6/1979 | Krakik . |
| 4,165,453 | 8/1979 | Hennemann . |
| 4,166,988 | 9/1979 | Ciarcia et al. . |
| 4,220,934 | 9/1980 | Wafer et al. . |
| 4,255,732 | 3/1981 | Wafer et al. . |
| 4,259,651 | 3/1981 | Yamat . |

(List continued on next page.)

FOREIGN PATENT DOCUMENTS

| | | |
|---|---|---|
| 12 27 978 | 11/1966 | (DE) . |
| 30 47 360 | 6/1982 | (DE) . |
| 38 02 184 | 8/1989 | (DE) . |
| 38 43 277 | 6/1990 | (DE) . |
| 44 19 240 | 1/1995 | (DE) . |
| 0 061 092 | 9/1982 | (EP) . |
| 0 064 906 | 11/1982 | (EP) . |
| 0 066 486 | 12/1982 | (EP) . |
| 0 076 719 | 4/1983 | (EP) . |
| 0 117 094 | 8/1984 | (EP) . |
| 0 140 761 | 5/1985 | (EP) . |
| 0 174 904 | 3/1986 | (EP) . |
| 0 196 241 | 10/1986 | (EP) . |
| 0 224 396 | 6/1987 | (EP) . |
| 0 235 479 | 9/1987 | (EP) . |
| 0 239 460 | 9/1987 | (EP) . |
| 0 258 090 | 3/1988 | (EP) . |
| 0 264 313 | 4/1988 | (EP) . |
| 0 264 314 | 4/1988 | (EP) . |
| 0 283 189 | 9/1988 | (EP) . |
| 0 283 358 | 9/1988 | (EP) . |
| 0 291 374 | 11/1988 | (EP) . |
| 0 295 155 | 12/1988 | (EP) . |

(List continued on next page.)

*Primary Examiner*—Lincoln Donovan
(74) *Attorney, Agent, or Firm*—Cantor Colburn LLP; Carl B. Horton

(57) ABSTRACT

A circuit breaker rotary contact arrangement is disclosed in which the ends of the line and load straps supporting the fixed contacts are hook-shaped to control the angle of the repulsive force exhibited between the fixed contacts and the movable contacts arranged at the opposing ends of the rotary contact arm. The fixed contacts face outwardly away from the central pivot of the contact arm such that a horizontal component of the popping force acts away from the center of rotation keeping the contact arm in tension for avoiding a buckling effect allowing contact arms with smaller cross sectional area to be used to increase contact arm mobility and reduce the cost.

14 Claims, 5 Drawing Sheets

U.S. PATENT DOCUMENTS

| | | | |
|---|---|---|---|
| 4,263,492 | | 4/1981 | Maier et al. . |
| 4,276,527 | | 6/1981 | Gerbert-Gaillard et al. . |
| 4,297,663 | | 10/1981 | Seymour et al. . |
| 4,301,342 | | 11/1981 | Castonguay et al. . |
| 4,360,852 | | 11/1982 | Gilmore . |
| 4,368,444 | | 1/1983 | Preuss et al. . |
| 4,375,021 | | 2/1983 | Pardini et al. . |
| 4,375,022 | | 2/1983 | Daussin et al. . |
| 4,376,270 | | 3/1983 | Staffen . |
| 4,383,146 | | 5/1983 | Bur . |
| 4,392,036 | | 7/1983 | Troebel et al. . |
| 4,393,283 | | 7/1983 | Masuda . |
| 4,401,872 | | 8/1983 | Boichot-Castagne et al. . |
| 4,409,573 | | 10/1983 | DiMarco et al. . |
| 4,435,690 | | 3/1984 | Link et al. . |
| 4,467,297 | | 8/1984 | Boichot-Castagne et al. . |
| 4,468,645 | | 8/1984 | Gerbert-Gaillard et al. . |
| 4,470,027 | | 9/1984 | Link et al. . |
| 4,479,143 | | 10/1984 | Watanabe et al. . |
| 4,488,133 | | 12/1984 | McClellan et al. . |
| 4,492,941 | | 1/1985 | Nagel . |
| 4,541,032 | | 9/1985 | Schwab . |
| 4,546,224 | | 10/1985 | Mostosi . |
| 4,550,360 | | 10/1985 | Dougherty . |
| 4,562,419 | | 12/1985 | Preuss et al. . |
| 4,589,052 | | 5/1986 | Dougherty . |
| 4,595,812 | | 6/1986 | Tamaru et al. . |
| 4,611,187 | | 9/1986 | Banfi . |
| 4,612,430 | | 9/1986 | Sloan et al. . |
| 4,616,198 | | 10/1986 | Pardini et al. . |
| 4,622,444 | | 11/1986 | Kandatsu et al. . |
| 4,631,625 | | 12/1986 | Alexander et al. . |
| 4,642,431 | | 2/1987 | Tedesco et al. . |
| 4,644,438 | | 2/1987 | Puccinelli et al. . |
| 4,649,247 | | 3/1987 | Preuss et al. . |
| 4,658,322 | | 4/1987 | Rivera . |
| 4,672,501 | | 6/1987 | Bilac et al. . |
| 4,675,481 | | 6/1987 | Markowski et al. . |
| 4,682,264 | | 7/1987 | Demeyer . |
| 4,689,712 | | 8/1987 | Demeyer . |
| 4,694,373 | | 9/1987 | Demeyer . |
| 4,710,845 | | 12/1987 | Demeyer . |
| 4,717,985 | | 1/1988 | Demeyer . |
| 4,733,211 | | 3/1988 | Castonguay et al. . |
| 4,733,321 | | 3/1988 | Lindeperg . |
| 4,764,650 | | 8/1988 | Bur et al. . |
| 4,768,007 | | 8/1988 | Mertz et al. . |
| 4,780,786 | | 10/1988 | Weynachter et al. . |
| 4,831,221 | | 5/1989 | Yu et al. . |
| 4,870,531 | | 9/1989 | Danek . |
| 4,883,931 | | 11/1989 | Batteux et al. . |
| 4,884,047 | | 11/1989 | Baginski et al. . |
| 4,884,164 | | 11/1989 | Dziura et al. . |
| 4,900,882 | | 2/1990 | Bernard et al. . |
| 4,910,485 | | 3/1990 | Bolongeat-Mobleu et al. . |
| 4,914,541 | | 4/1990 | Tripodi et al. . |
| 4,916,420 | | 4/1990 | Bartolo et al. . |
| 4,916,421 | * | 4/1990 | Pardini et al. ..... 335/185 |
| 4,926,282 | | 5/1990 | McGhie . |
| 4,935,590 | | 6/1990 | Malkin et al. . |
| 4,937,706 | | 6/1990 | Schueller et al. . |
| 4,939,492 | | 7/1990 | Raso et al. . |
| 4,943,691 | | 7/1990 | Mertz et al. . |
| 4,943,888 | | 7/1990 | Jacob et al. . |
| 4,950,855 | | 8/1990 | Bolonegeat-Mobleu et al. . |
| 4,951,019 | | 8/1990 | Gula . |
| 4,952,897 | | 8/1990 | Barnel et al. . |
| 4,958,135 | | 9/1990 | Baginski et al. . |
| 4,965,543 | | 10/1990 | Batteux . |
| 4,983,788 | | 1/1991 | Pardini . |
| 5,001,313 | | 3/1991 | Leclerq et al. . |
| 5,004,878 | | 4/1991 | Seymour et al. . |
| 5,029,301 | | 7/1991 | Nebon et al. . |
| 5,030,804 | | 7/1991 | Abri . |
| 5,057,655 | | 10/1991 | Kersusan et al. . |
| 5,077,627 | | 12/1991 | Fraisse . |
| 5,083,081 | | 1/1992 | Barrault et al. . |
| 5,095,183 | | 3/1992 | Raphard et al. . |
| 5,103,198 | | 4/1992 | Morel et al. . |
| 5,115,371 | | 5/1992 | Tripodi . |
| 5,120,921 | | 6/1992 | DiMarco et al. . |
| 5,132,865 | | 7/1992 | Mertz et al. . |
| 5,138,121 | | 8/1992 | Streich et al. . |
| 5,140,115 | | 8/1992 | Morris . |
| 5,153,802 | | 10/1992 | Mertz et al. . |
| 5,155,315 | | 10/1992 | Malkin et al. . |
| 5,166,483 | | 11/1992 | Kersusan et al. . |
| 5,172,087 | | 12/1992 | Castonguay et al. . |
| 5,178,504 | | 1/1993 | Falchi . |
| 5,184,717 | | 2/1993 | Chou et al. . |
| 5,187,339 | | 2/1993 | Lissandrin . |
| 5,198,956 | | 3/1993 | Dvorak . |
| 5,200,724 | | 4/1993 | Gula et al. . |
| 5,210,385 | | 5/1993 | Morel et al. . |
| 5,239,150 | | 8/1993 | Bolongeat-Mobleu et al. . |
| 5,260,533 | | 11/1993 | Livesey et al. . |
| 5,262,744 | | 11/1993 | Arnold et al. . |
| 5,280,144 | | 1/1994 | Bolongeat-Mobleu et al. . |
| 5,281,776 | | 1/1994 | Morel et al. . |
| 5,296,660 | | 3/1994 | Morel et al. . |
| 5,296,664 | | 3/1994 | Crookston et al. . |
| 5,298,874 | | 3/1994 | Morel et al. . |
| 5,300,907 | | 4/1994 | Nereau et al. . |
| 5,310,971 | | 5/1994 | Vial et al. . |
| 5,313,180 | | 5/1994 | Vial et al. . |
| 5,317,471 | | 5/1994 | Izoard et al. . |
| 5,331,500 | | 7/1994 | Corcoles et al. . |
| 5,334,808 | | 8/1994 | Bur et al. . |
| 5,341,191 | | 8/1994 | Crookston et al. . |
| 5,347,096 | | 9/1994 | Bolongeat-Mobleu et al. . |
| 5,347,097 | | 9/1994 | Bolongeat-Mobleu et al. . |
| 5,350,892 | | 9/1994 | Rozier . |
| 5,357,066 | | 10/1994 | Morel et al. . |
| 5,357,068 | | 10/1994 | Rozier . |
| 5,357,394 | | 10/1994 | Piney . |
| 5,361,052 | | 11/1994 | Ferullo et al. . |
| 5,373,130 | | 12/1994 | Barrault et al. . |
| 5,379,013 | | 1/1995 | Coudert . |
| 5,424,701 | | 6/1995 | Castonguary et al. . |
| 5,438,176 | | 8/1995 | Bonnardel et al. . |
| 5,440,088 | | 8/1995 | Coudert et al. . |
| 5,449,871 | | 9/1995 | Batteux et al. . |
| 5,450,048 | | 9/1995 | Leger et al. . |
| 5,451,729 | | 9/1995 | Onderka et al. . |
| 5,457,295 | | 10/1995 | Tanibe et al. . |
| 5,467,069 | | 11/1995 | Payet-Burin et al. . |
| 5,469,121 | | 11/1995 | Payet-Burin . |
| 5,475,558 | | 12/1995 | Barjonnet et al. . |
| 5,477,016 | | 12/1995 | Baginski et al. . |
| 5,479,143 | | 12/1995 | Payet-Burin . |
| 5,483,212 | | 1/1996 | Lankuttis et al. . |
| 5,485,343 | | 1/1996 | Santos et al. . |
| 5,493,083 | | 2/1996 | Olivier . |
| 5,504,284 | | 4/1996 | Lazareth et al. . |
| 5,504,290 | | 4/1996 | Baginski et al. . |
| 5,510,761 | | 4/1996 | Boder et al. . |
| 5,512,720 | | 4/1996 | Coudert et al. . |
| 5,515,018 | | 5/1996 | DiMarco et al. . |
| 5,519,561 | | 5/1996 | Mrenna et al. . |
| 5,534,674 | | 7/1996 | Steffens . |
| 5,534,832 | | 7/1996 | Duchemin et al. . |

| | | |
|---|---|---|
| 5,534,835 | 7/1996 | McColloch et al. . |
| 5,534,840 | 7/1996 | Cuingnet . |
| 5,539,168 | 7/1996 | Linzenich . |
| 5,543,595 | 8/1996 | Mader et al. . |
| 5,552,755 | 9/1996 | Fello et al. . |
| 5,581,219 | 12/1996 | Nozawa et al. . |
| 5,604,656 | 2/1997 | Derrick et al. . |
| 5,608,367 | 3/1997 | Zoller et al. . |
| 5,784,233 | 7/1998 | Bastard et al. . |

FOREIGN PATENT DOCUMENTS

| | | |
|---|---|---|
| 0 295 158 | 12/1988 | (EP) . |
| 0 309 923 | 4/1989 | (EP) . |
| 0 313 106 | 4/1989 | (EP) . |
| 0 313 422 | 4/1989 | (EP) . |
| 0 314 540 | 5/1989 | (EP) . |
| 0 331 586 | 9/1989 | (EP) . |
| 0 337 900 | 10/1989 | (EP) . |
| 0 342 133 | 11/1989 | (EP) . |
| 0 367 690 | 5/1990 | (EP) . |
| 0 371 887 | 6/1990 | (EP) . |
| 0 375 568 | 6/1990 | (EP) . |
| 0 394 144 | 10/1990 | (EP) . |
| 0 394 922 | 10/1990 | (EP) . |
| 0 399 282 | 11/1990 | (EP) . |
| 0 407 310 | 1/1991 | (EP) . |
| 0 452 230 | 10/1991 | (EP) . |
| 0 555 158 | 8/1993 | (EP) . |
| 0 560 697 | 9/1993 | (EP) . |
| 0 567 416 | 10/1993 | (EP) . |
| 0 595 730 | 5/1994 | (EP) . |
| 0 619 591 | 10/1994 | (EP) . |
| 0 665 569 | 8/1995 | (EP) . |
| 0 700 140 | 3/1996 | (EP) . |
| 0 889 498 | 1/1999 | (EP) . |
| 2 410 353 | 6/1979 | (FR) . |
| 2 512 582 | 3/1983 | (FR) . |
| 2 553 943 | 4/1985 | (FR) . |
| 2 592 998 | 7/1987 | (FR) . |
| 2 682 531 | 4/1993 | (FR) . |
| 2 697 670 | 5/1994 | (FR) . |
| 2 699 324 | 6/1994 | (FR) . |
| 2 714 771 | 7/1995 | (FR) . |
| 2 233 155 | 1/1991 | (GB) . |
| 92/00598 | 1/1992 | (WO) . |
| 92/05649 | 4/1992 | (WO) . |
| 94/00901 | 1/1994 | (WO) . |

* cited by examiner

CIRCUIT BREAKER ROTARY CONTACT ARRANGEMENT

BACKGROUND OF THE INVENTION

This invention relates to circuit breakers, and, more particularly, to circuit breakers having a rotary contact arm arrangement.

U.S. Pat. No. 4,616,198 entitled "Contact Arrangement for a Current Limiting Circuit Breaker" describes the early use of a first and second pair of circuit breaker contacts arranged in series to substantially reduce the amount of current let-through upon the occurrence of an overcurrent condition.

When the contact pairs are arranged upon one movable contact arm such as described within U.S. Pat. No. 4,910,485 entitled "Multiple Circuit Breaker with Double Break Rotary Contact", some means must be provided to insure that the opposing contact pairs exhibit the same contact pressure to reduce contact wear and erosion.

One arrangement for providing uniform contact wear is described within U.S. Pat. 4,649,247 entitled "Contact Assembly for Low-voltage Circuit Breakers with a Two-Arm Contact Lever". This arrangement includes an elongate slot formed perpendicular to the contact travel to provide uniform contact closure force on both pairs of contacts.

State of the art circuit breakers employing a rotary contact arrangement employ a rotor assembly and pair of powerful expansion springs to maintain contact between the rotor assembly and the rotary contact arm as well as to maintain good electrical connection between the contacts. The added compression forces provided by the powerful expansion springs must be overcome when the contacts become separated by the so-called "popping force" of magnetic repulsion that occurs upon over-current conditions to momentarily separate the circuit breaker contacts within the protected circuit before the circuit breaker operating mechanism has time to respond. The thickness of the moveable contact arm as well as the size of the contact springs has heretofore been increased to proportionately increase the overcurrent level at which the popping force causes the contacts to become separated. However, increased thickness and size decreases contact arm mobility and increases the cost.

SUMMARY OF THE INVENTION

In an exemplary embodiment of the invention, a movable contact arm arrangement for rotary contact circuit breakers comprises a movable contact arm having a central pivot point adapted to be pivotally connected within a circuit breaker interior. A first movable contact is arranged at first end of the contact arm and a second movable contact is arranged at a second end of the contact arm. A line strap arranged at the first end of the contact arm has first end portion with a first fixed contact connected thereto and arranged opposite the first movable contact. A second end portion of the line strap is adapted for connection within an electric circuit. The line strap has a hook-shaped configuration so that an outer face of the first fixed contact faces away from the central pivot point of the contact arm and is further arranged at a non-zero degree angle relative to the second end portion of the line strap.

DESCRIPTION OF THE PREFERRED EMBODIMENT

Figure 1:
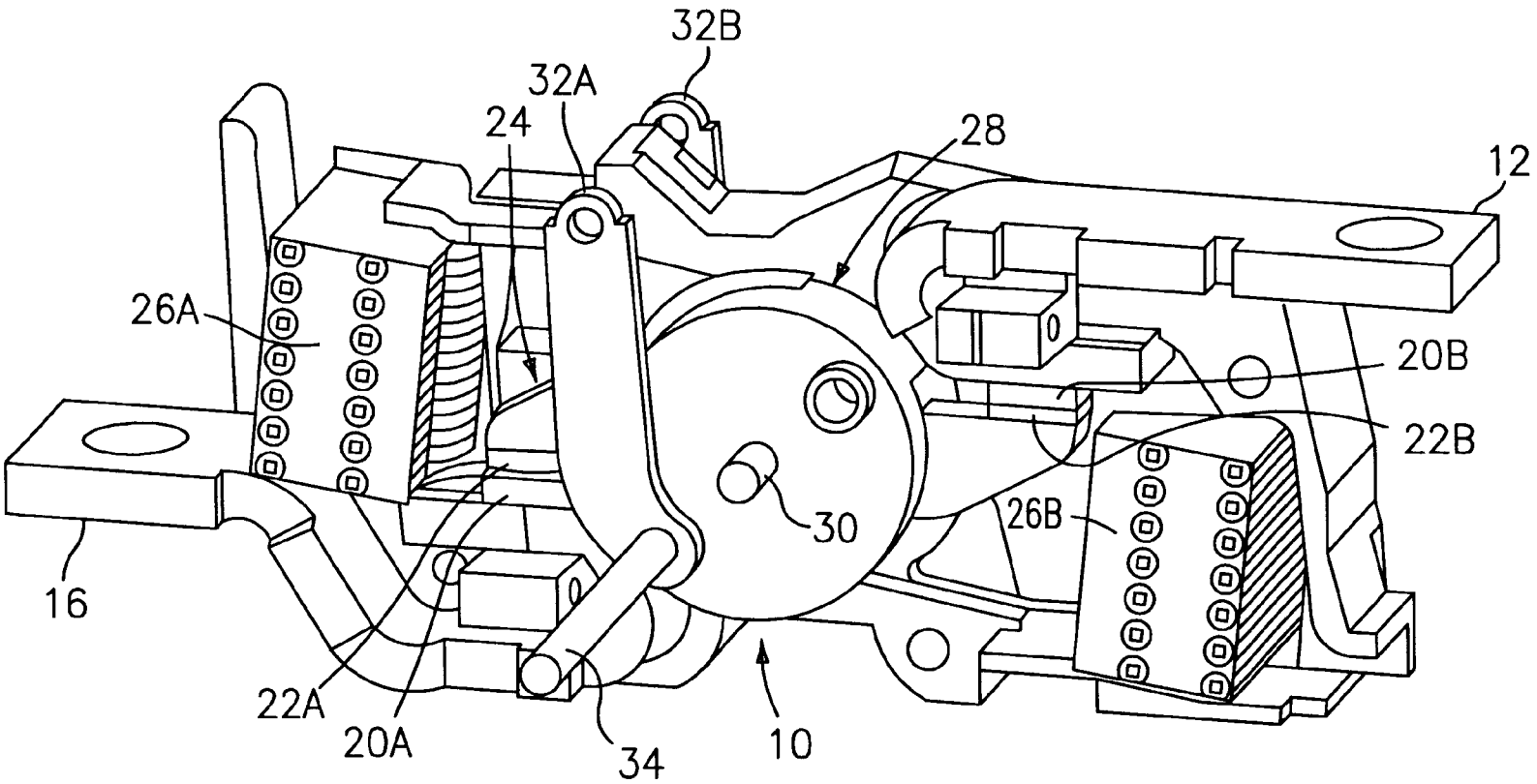
FIG. 1 (PRIOR ART)
FIG. 1 is a front perspective view of a circuit breaker interior depicting a rotary contact arrangement.

The rotor assembly 10 in the circuit breaker interior assembly is depicted in FIG. 1 intermediate the line strap 12 and load strap 16 and the associated arc chutes 26A, 26B. Although a single rotor assembly is shown, it is understood that a separate rotor assembly is employed within each pole of a multi-pole circuit breaker and operates in a similar manner. Electrical transport through the circuit breaker interior proceeds from the line strap 12 to the associated fixed contact 20B to the movable contact 22B connected to one end of the movable contact arm 24. The current transfers then to the opposite movable and fixed contacts 22A, 20A to the associated load strap 16. The movable contact arm 24 moves a central pivot 30 in unison with the rotor 28 which connects with the circuit breaker operating mechanism (not shown) by means of the levers 32A, 32B to move the movable contacts 22A, 22B between OPEN, CLOSED and TRIPPED positions. The central pivot 30 responds to the rotational movement of the rotor 28 to effect the contact closing and opening function. The extended pin 34 provides attachment of the rotor 28 with the circuit breaker operating handle (not shown) to allow manual intervention for opening and closing the circuit breaker contacts.

Figure 2:
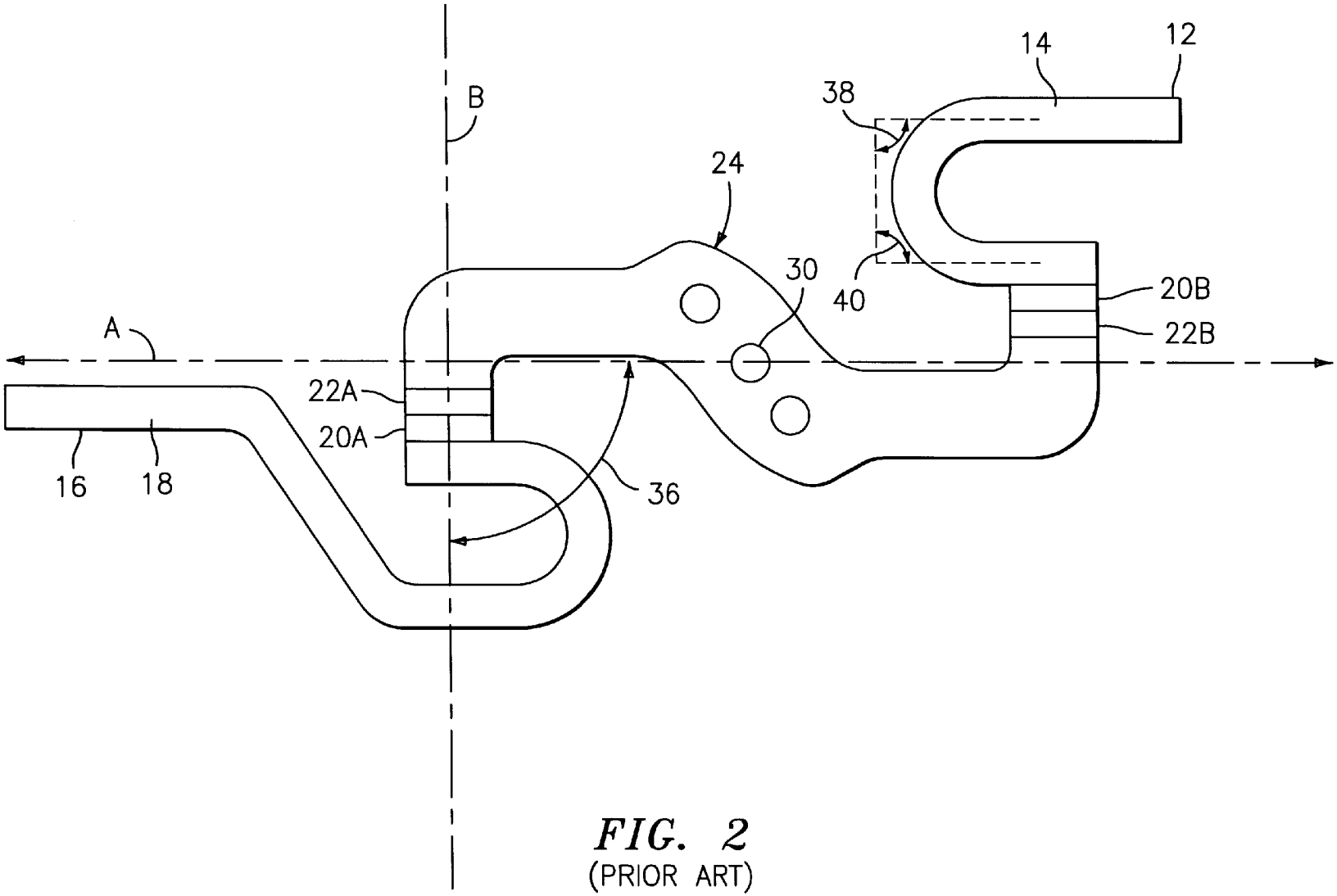
FIG. 2 (PRIOR ART)
FIG. 2 is an enlarged front plan view of the prior art rotary contact arrangement within the rotary contact arrangement of FIG. 1.

The contact arm 24 is shown in FIG. 2 intermediate the line and load straps 12, 16 to depict the positional relationship between the fixed and movable contacts 20A, 20B, 22A, 22B. The popping force, which is proportional to the square of the current, is normal to the surface of the contacts 20A, 20B. The contacts can pop (separate) when the moment due to popping force can overcome the contact pressure induced by the rotor spring force. The line of force B acting through the contacts 20A, 22A is shown in phantom. Plane A, also shown in phantom, passes through the pivot 30 and is parallel to end portions 14 and 18 of line and load straps 12 and 16, respectively. It is further noted that the contacts are positioned parallel to the plane A and that the line and load straps each define a pair of adjacent 90 degree angles 38 and 40.

The popping force, defined earlier, is a factor of the moment defined by the length of the movable contact arm 24 from the axis of rotation, defined by pivot 30, multiplied by the sine of the angle 36 defined between the reference lines A and B. With the angle 36 equal to 90 degrees, as is shown in FIG. 2, the sine of the angle is equal to one resulting in a maximum popping force that must be overcome to prevent contact popping at correspondingly low over-current values.

Figure 3:
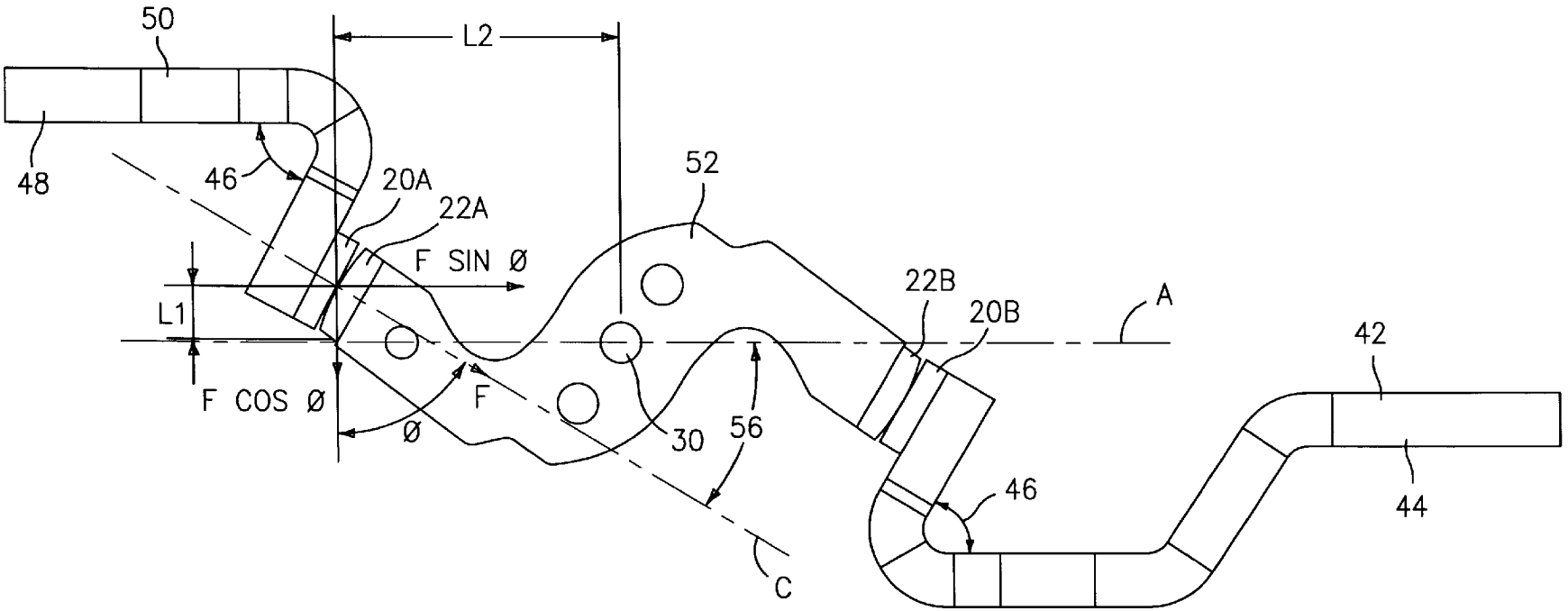
FIG. 3 (PRIOR ART)
FIG. 3 is an enlarged front plan view of another prior art rotary contact arrangement.

Turning now to FIG. 3, an alternate contact arm arrangement of the prior art is shown. The movable contact arm 52 intermediate the line and load straps 42, 48 depict the positional relationship between the fixed and movable contacts 20A, 20B, 22A, 22B. The line of force C acting through the contacts 20A, 22A is shown in phantom. The plane A, also shown in phantom, passes through the pivot 30 and is parallel to end portions 44 and 50 of the line and load straps 42 and 48. The line and load straps 42 and 48 each define a single acute angle 46 to angle the fixed contacts 20B and 20A towards the contact arm 52. Thus, an angle 56 is defined between the line of force C and the plane A. With the angle 56 equal to 45 degrees, for example, the sine of the angle is less than one (approximately 0.707), resulting in almost a third less the value of the popping force associated with the Prior Art arrangement shown earlier in FIG. 1. However, as further shown in FIG. 3, the popping force F, when broken down into horizontal and vertical components Fsin $\phi$ and Fcos $\phi$, respectively, demonstrates a horizontal component Fsin $\phi$ which acts towards the center of rotation 30 of the arm 52 (where the angle $\phi$ is defined as the angle between the popping force F, along the line of force C, and the vertical component of the popping force F, i.e. Fcos $\phi$, along a line perpendicular to plane A). A buckling effect is thus created, due to the Fsin $\phi$ component of repulsion forces acting towards the center of rotation 30. Therefore, contact arm 52 must be designed with increased cross-sectional area to withstand this buckling effect which in turn results in decreased contact arm mobility and increased cost.

Figure 4:
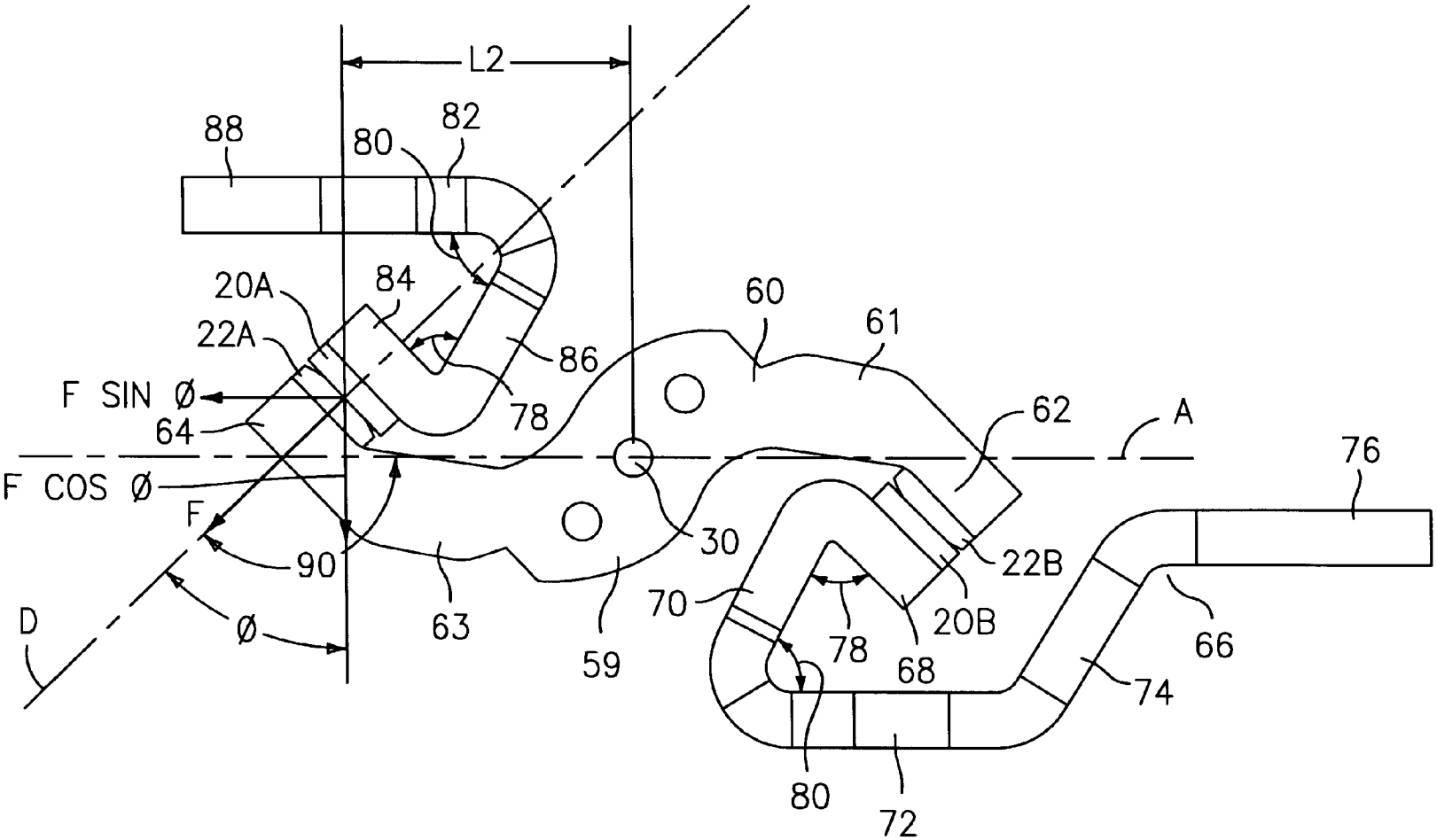
FIG. 4 is an enlarged front plan view of a rotary contact arrangement of the present invention; and, FIGS. 5A and 5B compare the contact gaps created in the arrangements for FIG. 3 and FIG. 4, respectively, upon rotation of the contact arm.

According to an embodiment of the present invention, FIG. 4 shows a contact arm 60 having a first end 62 and a second end 64. The contact arm 60 further includes a central section 59, a first connecting arm 61 extending angularly from one comer of the central section 59, and a second connecting arm 63 extending angularly from a diagonally opposite corner fo the central section 59. Again, the positional relationship between the fixed and movable contacts 20A, 20B, 22A, 22B is shown. The present invention reduces the moment created by the popping force by inclining the contacts at an angle. The line of force D acting through the contacts 20A, 22A is shown in phantom. The plane A, also shown in phantom, passes through the pivot 30 and is parallel to second end portions 76 and 88 of the line and load straps 66 and 82.

As shown, the line and load straps 66 and 82 each define a pair of adjacent acute angles 78 and 80 to angle an outer face of the fixed contacts 20B and 20A away from the center of the contact arm 60. That is, an acute angle 78 is formed between first end portion 68 and portion 70, and another acute angle 80 is formed between portion 70 and portion 84 of line strap 66. Likewise, an acute angle 78 is formed between first end portion 84 and portion 86, and another acute angle 80 is formed between portion 86 and second end portion 88 of load strap 82. Thus, an angle 90 is defined between the line of force D and the plane A. With the angle 90 equal to 135 degrees, for example, the sine of the angle is less than one (approximately 0.707), resulting in almost a third less the value of the popping force associated with the Prior Art arrangement shown earlier in FIG. 1. Reduction of the moment due to popping force indicates increased popping level at which the contacts pop. The present invention increases the amount of overcurrent that can pass through the contact arm before contact popping occurs, which causes contact erosion. If the moment of the force required to pop the contact is less, then popping of the contacts can be minimized thus reducing the erosion of the contact. The angle 90 can be altered for optimal results in each application. Although the line and load straps 66 and 82 are shown with acute angles 78 and 80, it should be noted that the line and load straps could be formed in a continuous curve such that the fixed contacts 20B and 20A still face in the same direction as shown.

Advantageously, the popping force F of this embodiment, when broken down into horizontal and vertical components Fsin $\phi$ and Fcos $\phi$, respectively, demonstrates a horizontal component Fsin $\phi$ which acts away from the center of rotation 30 of the arm 60, keeping the contact arm 60 in tension. By using this design, the buckling effect created in the embodiment shown in FIG. 3 can be avoided. Therefore, contact arms with smaller cross sectional area can be used to increase contact arm mobility, and also reduce the cost. Lighter contact springs (not shown) can also be employed.

Figure 5A:
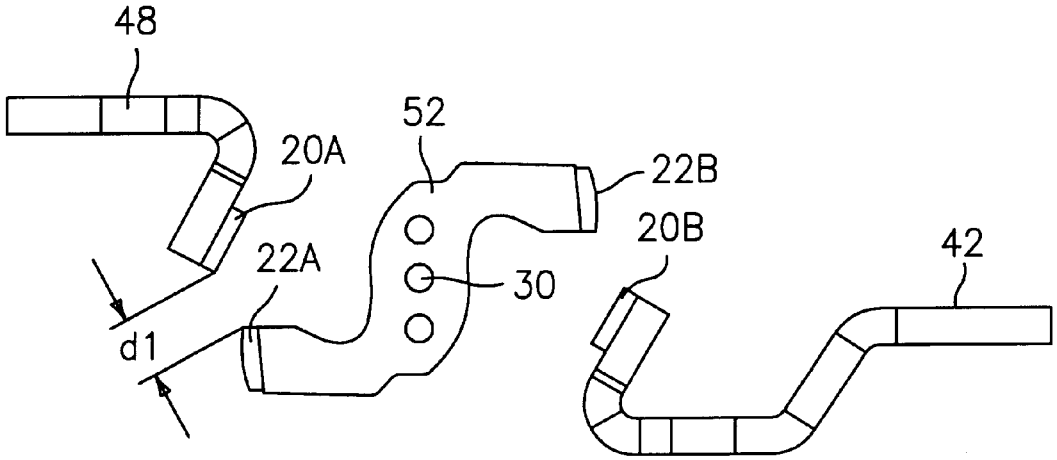
FIG. 5A (PRIOR ART)
Figure 5B:
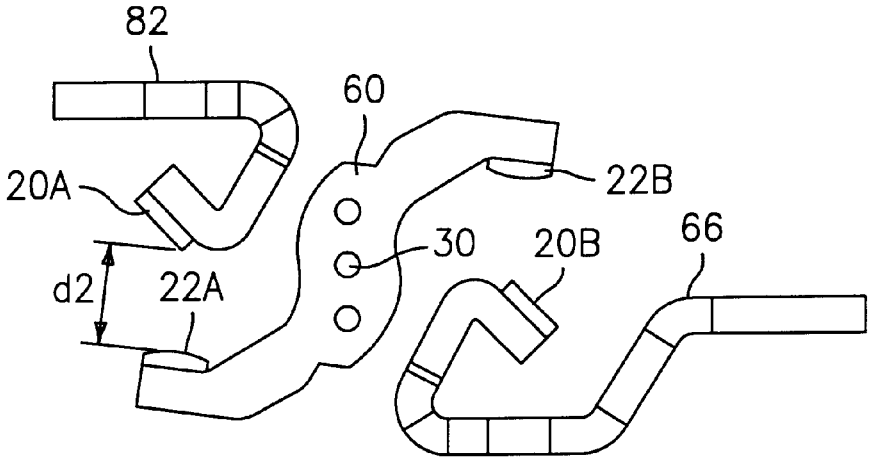

A further advantage to the embodiment of FIG. 4 is demonstrated by a comparison of FIGS. 5A and 5B. FIGS. 5A and 5B show contact arms 52 and 60, respectively, each rotated counterclockwise an equal number of degrees. As can be seen, however, the distance d1 between movable contact 22A and fixed contact 20A of FIG. 5A is less than the distance d2 between movable contact 22A and fixed contact 20A of FIG. 5B. Thus, the contact gap d2 of FIG. 5B is greater than the contact gap d1 of FIG. 5A per degree rotation, thereby enabling interruption at higher voltage stresses in the embodiment of FIG. 4.

A simple and effective arrangement has herein been described for controlling the popping force within rotary contact circuit breakers for improved overall circuit breaker performance and lower costs.

While the invention has been described with reference to a preferred embodiment, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

What is claimed is:

1. A movable contact arm arrangement for rotary contact circuit breakers comprising:

a movable contact arm having a central section with a longitudinal axis, a first connecting arm extending from one comer of the central section, a second connecting arm extending from a diagonally opposite comer of the central section, a first end connected to the first connecting arm, a second end connected to the second connecting arm, the movable contact arm pivotable about a central pivot point within the central section;

a first movable contact arranged at the first end of said contact arm and a second movable contact arranged at the second end of said contact arm; and a line strap adjacent the first end of said contact arm, said line strap having a first end portion having a first fixed contact;

wherein the movable contact arm is pivotable about the central pivot point between a closed position where the first movable contact abuts an outer face of the first fixed contact and an open position where the first movable contact becomes separated from the first fixed contact, the outer face of the first fixed contact facing away from the longitudinal axis of the central section of the movable contact arm when the movable contact arm is in the closed position.

2. The arrangement of claim 1 including a load strap adjacent the second end of said contact arm, said load strap having a first end portion having a second fixed contact, wherein the second movable contact abuts the outer face of the second fixed contact in the closed position and the second movable contact becomes separated from the second fixed contact in the open position, the outer face of the second fixed contact facing away from the longitudinal axis of the central section of the movable contact arm when the movable contact arm is in the closed position.

3. The arrangement of claim 2 wherein a first vector having a starting point on the outer face of the first fixed contact and protruding perpendicularly from the first fixed contact away from the first end portion of the line strap includes a first horizontal vector component, pointing away from the central pivot point, and a first vertical vector component.

4. The arrangement of claim 3 wherein a second vector having a starting point on the outer face of the second fixed contact and protruding perpendicularly from the second fixed contact away from the first end portion of the load strap includes a second horizontal vector component, pointing away from the central pivot point, and a second vertical vector component, wherein the first and second horizontal vector components are parallel to each other and point in opposite directions.

5. The arrangement of claim 1 wherein the line strap further includes a second end portion, a third portion adjacent the first end portion and a fourth portion adjacent the third portion, a first acute angle being formed between the first end portion and the third portion, and a second acute angle being formed between the third portion and the fourth portion.

6. The arrangement of claim 2 wherein the load strap further includes a second end portion, a third portion, intermediate the first end portion and the second end portion of the load strap, a first acute angle formed between the first end portion and the third portion of the load strap, and a second acute angle formed between the third portion and the second end portion of the load strap.

7. The arrangement of claim 1 wherein, when the movable contact arm is in the closed position, a line passing perpendicularly through both the first fixed contact and the first movable contact is generally parallel to the longitudinal axis of the central section.

8. A rotary contact circuit breaker interior comprising:

a movable contact arm having a central section having a longitudinal axis and a central pivot point, the movable contact arm further having a first connecting arm projecting angularly from the central section and a second connecting arm projecting from the central section in a direction diagonally opposite the first connecting arm, a first end extending from the first connecting arm and a second end extending from the second connecting arm, the movable contact arm arranged between a pair of arc chutes;

a first movable contact arranged at the first end of said contact arm and a second movable contact arranged at the second end of said contact arm; and a line strap adjacent the first end of said contact arm, said line strap having a first end portion having a first fixed contact;

wherein the movable contact arm is pivotable about the central pivot point between a closed position where the first movable contact abuts the first fixed contact and an open position where the first movable contact becomes separated from the first fixed contact, an outer face of the first fixed contact facing away from the longitudinal axis of the central section of the movable contact arm when the movable contact arm is in the closed position.

9. The breaker interior of claim 8 including a load strap adjacent the second end of said movable contact arm, said load strap having a first end portion having a second fixed contact, an outer face of the second fixed contact facing away from the longitudinal axis of the central section of the movable contact arm.

10. The breaker interior of claim 9 wherein a first vector having a starting point on the outer face of the first fixed contact and protruding perpendicularly from the first fixed contact away from the first end portion of the line strap includes a first horizontal vector component, pointing away from the central pivot point and a first vertical vector component.

11. The breaker interior of claim 10 wherein a second vector having a starting point on the outer face of the second fixed contact and protruding perpendicularly from the second fixed contact away from the first end portion of the load strap includes a second horizontal vector component, pointing away from the central pivot point, and a second vertical vector component, wherein the first and second horizontal vector components are parallel to each other and point in opposite directions.

12. The breaker interior of claim 8 wherein the line strap further includes a second end portion, a third portion adjacent the first end portion and a fourth portion adjacent the third portion, a first acute angle being formed between the first end portion and the third portion, and a second acute angle being formed between the third portion and the fourth portion.

13. The breaker interior of claim 9 wherein the load strap further includes a second end portion, a third portion, intermediate the first end portion and the second end portion of the load strap, a first acute angle formed between the first end portion and the third portion of the load strap, and a second acute angle formed between the third portion and the second end portion of the load strap.

14. The breaker interior of claim 8 wherein, when the movable contact arm is in the closed position, a line passing perpendicularly through both the first fixed contact and the first movable contact is generally parallel to the longitudinal axis of the central section.

* * * * *

UNITED STATES PATENT AND TRADEMARK OFFICE

CERTIFICATE OF CORRECTION

PATENT NO. : 6,184,761 B1
DATED : February 6, 2001
INVENTOR(S) : Doma et al.

It is certified that error appears in the above-identified patent and that said Letters Patent is hereby corrected as shown below:

Column 3,
Line 23, after "one" delete "comer" and insert therefor -- corner --
Line 25, after "corner" delete "fo" and insert therefor -- of --

Column 4,
Lines 38 and 39, after "one" delete "comer" and insert therefor -- corner --

Signed and Sealed this

Thirteenth Day of July, 2004

JON W. DUDAS
*Acting Director of the United States Patent and Trademark Office*